US006868046B2

(12) United States Patent
Farine et al.

(10) Patent No.: US 6,868,046 B2
(45) Date of Patent: Mar. 15, 2005

(54) ELECTRONIC WATCH INCLUDING CAPACITIVE KEYS ON ITS CRYSTAL

(75) Inventors: Pierre-André Farine, Neuchâtel (CH); Jean-Charles Guanter, Diesse (CH); Sergio Rota, Neuchâtel (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 09/985,151

(22) Filed: Nov. 1, 2001

(65) Prior Publication Data

US 2002/0060953 A1 May 23, 2002

(30) Foreign Application Priority Data

Nov. 17, 2000 (CH) ..... 2238/00

(51) Int. Cl.[7] ..... G04B 19/24

(52) U.S. Cl. ..... 368/28; 368/69; 368/80; 368/187

(58) Field of Search ..... 368/69, 80, 187, 368/223, 296, 62

(56) References Cited

U.S. PATENT DOCUMENTS 4,090,353 A * 5/1978 Maeda et al. ..... 307/116
4,228,534 A * 10/1980 Fellrath et al. ..... 307/116
4,257,115 A * 3/1981 Hatuse et al. ..... 368/232
4,475,822 A * 10/1984 Muller et al. ..... 368/296
5,453,960 A * 9/1995 Teres et al. ..... 368/224
5,742,564 A * 4/1998 Kuschel et al. ..... 368/224

FOREIGN PATENT DOCUMENTS

| | | |
|---|---|---|
| DE | 33 17 463 | 11/1984 |
| DE | 43 02 023 | 7/1994 |
| FR | 2759792 | 8/1998 |

OTHER PUBLICATIONS

Patent Abstract of Japan, vol. 012, No. 088, Mar. 23, 1988 & JP 62 222183 Sep. 30, 1987.

Patent Abstract of Japan, vol. 010, No. 294, Oct. 7, 1986 & JP 61 111485, May 29, 1986.

* cited by examiner

*Primary Examiner*—Kamand Cuneo
*Assistant Examiner*—Thanh S. Phan
(74) *Attorney, Agent, or Firm*—Sughrue Mion, PLLC

(57) ABSTRACT

The watch is provided with a circular row of capacitive keys defined by transparent electrodes (21 to 32) arranged on the inner face of the crystal (5) of the watch and connected to a detection device via a multiplexer. These keys are activated by the person wearing the watch placing a finger (38) on the crystal facing one of the electrodes. The watch further includes means for detecting the position of at least one of the hands (8, 9) by means of the same detection device, using the electrodes (21 to 32) of the capacitive keys and/or other fixed electrodes (51).

14 Claims, 3 Drawing Sheets

Fig. 3
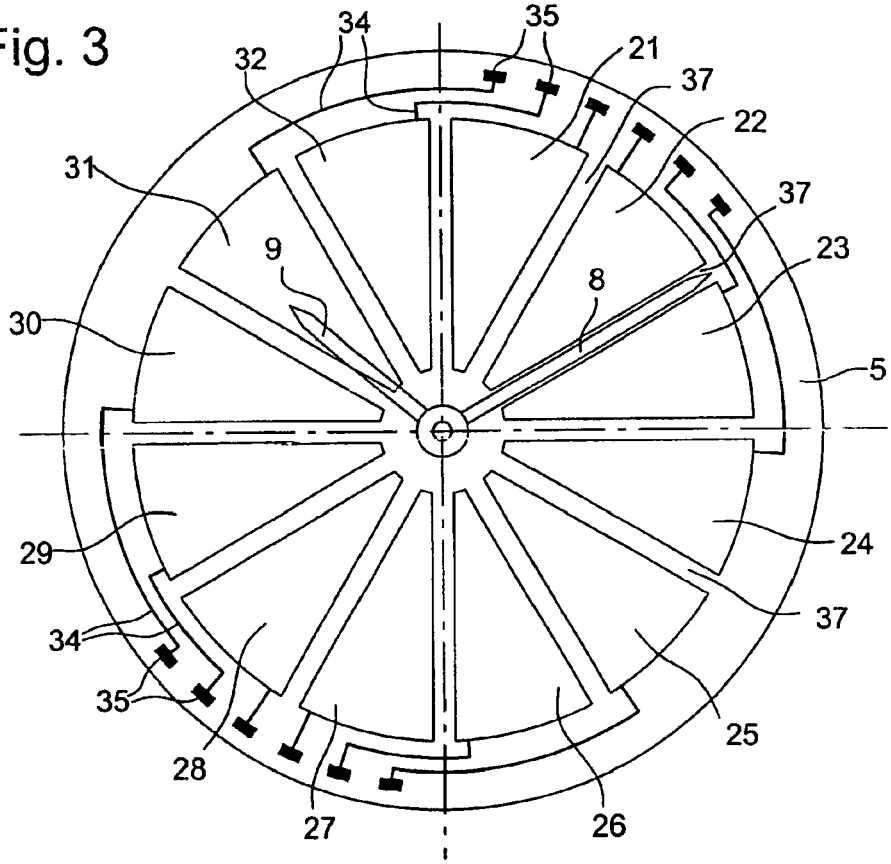
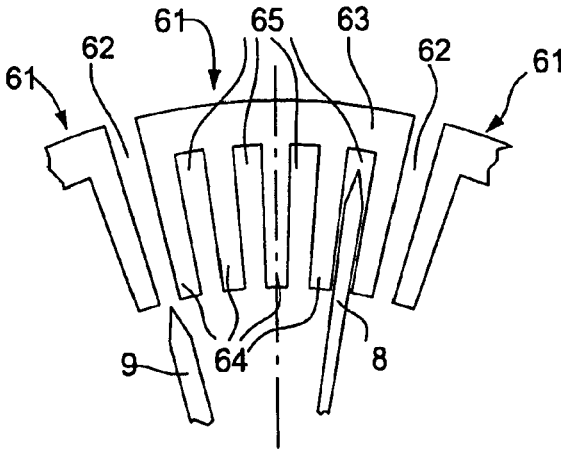
Fig.4
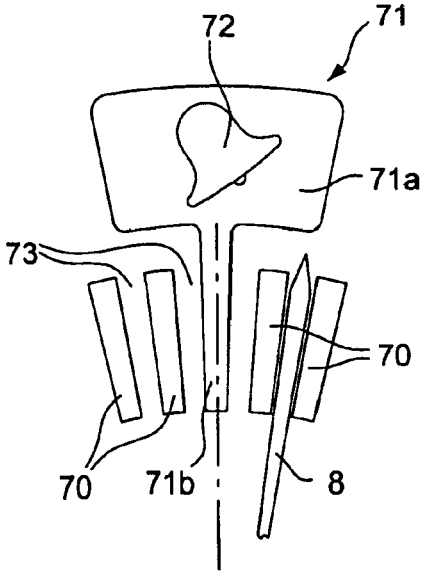
Fig. 5

ELECTRONIC WATCH INCLUDING CAPACITIVE KEYS ON ITS CRYSTAL

BACKGROUND OF THE INVENTION

The present invention concerns an electronic watch including a case containing display means with hands and provided with a crystal made of dielectric material arranged in front of said hands, and manual control means including capacitive keys each provided with a transparent electrode arranged on the inner face of the crystal and forming a first plate of a capacitive sensor whose second plate is formed by placing a finger of the person wearing the watch on the external face of the crystal selectively opposite at least one of the capacitive keys, the control means further including detection means for detecting capacitance variations in said sensors and consequently generating control signals in the watch.

A watch of this type is disclosed for example in European Patent No. 674 247. The control device with capacitive keys allows the usual external control members to be replaced, such as push-buttons, used to control the various functions of a watch, for example time-setting, starting and stopping a chronograph or entry to a particular operating mode.

Other watches have a capacitive device for detecting the position of a watch hand, in particular for the purpose of checking and correcting if necessary agreement between the real position of the hand and its theoretical position stored in a counter of the electronic watch movement, or for detecting the position of a hand indicating the alarm time. For example, German Patent Application No. 33 17 463 and Japanese Patent Application No. 8-201537 A propose detecting variations in capacitance between the metal hands, on the one hand, and one or two series of fixed electrodes placed on the dial, on the other hand. Japanese Patent Application No. 10-10243 A further proposes that the fixed electrode may be a transparent electrode fixed under the watch crystal.

SUMMARY OF THE INVENTION

A basic idea of the present invention consists in combining the two aforementioned devices in an electronic watch. Further, the invention achieves this combination in a remarkably simple manner.

According to a first aspect, the invention concerns an electronic watch of the type indicated in the preamble hereinbefore, characterised in that it includes means for the capacitive detection of position of at least one of the hands, on the basis of variations in capacitance between said hand and at least one of the transparent electrodes of the capacitive keys.

An advantageous combination of the two capacitive detection systems is thus obtained, owing to the common use of transparent electrodes arranged under the crystal, as well as electric connections between these electrodes and the detection means generally located in the electronic watch movement.

According to a second aspect, the invention concerns an electronic watch of the type indicated in the preamble hereinbefore, characterised in that it includes means for the capacitive detection of the position of at least one of the hands, said hand position detection being effected by means of the detection device associated with the capacitive keys, on the basis of variations in capacitance between said hand and at least one fixed electrode.

Given that each metal hand whose position one wishes to detect is generally connected to a fixed potential, in particular the earth of the watch's electric circuits, like the finger of the person wearing the watch acting on the capacitive keys, this particularly advantageous aspect of the invention consists in using the same electronic means for detecting the position of the hand or hands and the presence of a finger on a key. In other words, the addition of hand position detection in a watch with capacitive keys of the type disclosed in European Patent No. 674 247 may be made without any substantial modification to the electronic detection circuit.

It goes without saying that the two aforementioned aspects of the invention may advantageously be combined in a watch, as will be described hereinafter.

BRIEF DESCRIPTION OF THE DRAWINGS

Other features and advantages of the invention will appear in the following description of a preferred embodiment example and various variants, with reference to the annexed drawings, in which:

FIG. 3 shows a schematic representation of a first embodiment of the transparent electrodes arranged on the watch crystal;

FIG. 4 shows another embodiment of the transparent electrodes;

FIG. 5 shows a further embodiment of the transparent electrodes; and

DETAILED DESCRIPTION OF THE INVENTION

Figure 1:
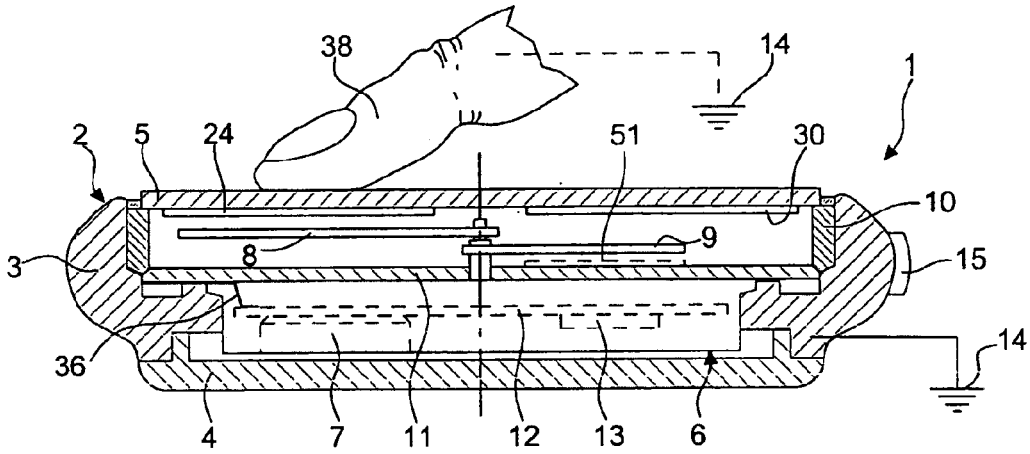
FIG. 1 is a schematic cross-section of a wristwatch according to the invention.

Watch 1 shown in FIG. 1 includes in a conventional manner a sealed case 2 including a metal middle part 3, a back cover 4 and a crystal 5 made of a dielectric material, for example mineral glass, organic glass or sapphire. Case 2 contains an electronic watch movement 6, an electric battery 7 and analogue display means including in particular a minute hand 8 and an hour hand 9 which turn in a space defined by a flange 10 between crystal 5 and a dial 11. In movement 6 a printed circuit board 12 carrying one or more integrated circuits 13 is shown schematically. Case 2, and metal hands 8 and 9 are connected to a fixed potential defined by one of the terminals of battery 7 and forming electric earth 14. It should be noted that heights have been exaggerated in FIG. 1 in order to clarify the drawing.

Watch 1 is fitted with a control device with capacitive keys based on the principles described in European Patent No. 674 247 and started using a manual control member such as a push-button 15. In the present case, the capacitive keys are formed by twelve transparent electrodes 21 to 32 shown in FIG. 3 and fixed against the inner face of crystal 5, facing the area swept by minute hand 8. Electrodes 21 to 32 are preferably formed by a layer of conductive oxide such as ITO (Indium Tin Oxide), this layer further including connection paths 34 and contact pads 35 to connect each of the electrodes to printed circuit board 12 via individual conductors 36 and monolithic zebra type connectors (not shown) in flange 10. In FIG. 3, pads 35 are grouped in two zones diametrically opposite crystal 5, but they could be grouped in a single zone or in several.

In the present example, electrodes 21 to 32 have a substantially trapezoid shape, to cover most of the length of minute hand 8, and they are separated by spaces 37 in the form of radial strips of constant width, substantially equal to or slightly greater than the width of hand 8. Spaces 37 are offset angularly by 30° with respect to each other and are preferably located facing the conventional hour symbols on the dial from one to twelve o'clock. This allows the position of hand 8 facing these symbols to be detected precisely, as will be described hereinafter. The capacitive keys defined by electrodes 21 to 32 may be identified by names, numbers or symbols placed for example on the dial, on the crystal or on the bezel of the case.

Figure 2:
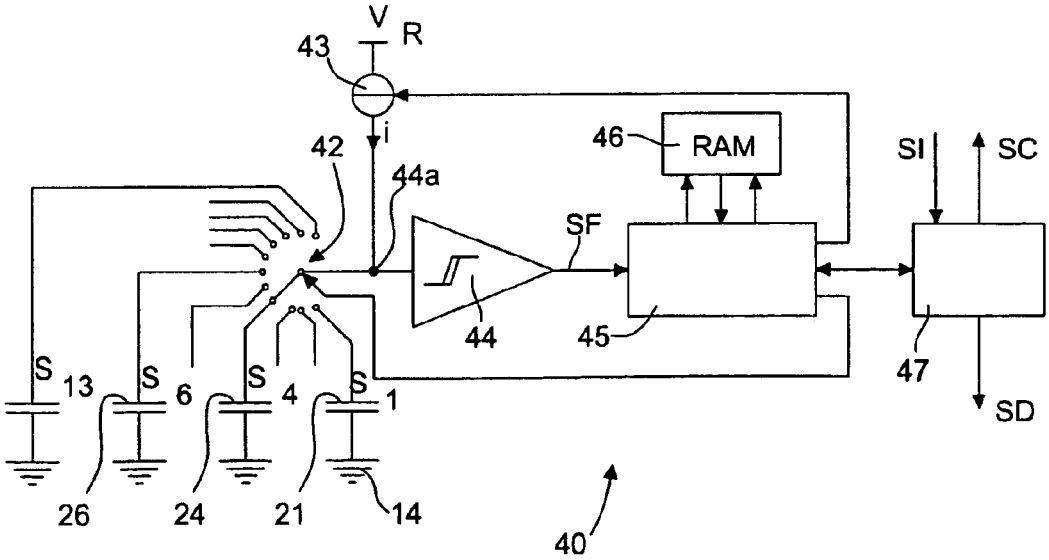
FIG. 2 is a diagram showing the detection means used in the watch of FIG. 1.

Each of electrodes 21 to 32 forms one of the plates of a capacitive sensor the other plate of which is formed by a finger 38 of the person wearing the watch when he places his finger on crystal 5, selectively facing the electrode concerned. Finger 38 is electrically connected to earth 14 via watch case 2. In the capacitive sensor, placing finger 38 on the key formed by the transparent electrode concerned creates quite a large increase in capacitance in the sensor concerned, compared to the parasite capacitance existing between the electrode and the case. This variation in capacitance is detected by a detection device 40 shown in FIG. 2 and incorporated in one of the integrated circuits 13 of movement 6. The twelve transparent electrodes 21 to 32 are connected to twelve respective terminals of an analogue multiplexer 42 of detection device 40. In other words, the twelve capacitive sensors are connected in parallel between multiplexer 42 and earth 14. In FIG. 2 shows three of these sensors by way of example designated S1, S4 and S6 and including respectively electrodes 21, 24 and 26. A capacitance S13, also connected between multiplexer 42 and earth, acts as a reference and is preferably located on printed circuit board 12.

Detection device 40 includes a controlled current source 43, powered by a reference voltage $V_R$, an amplifier and voltage limiter circuit 44, a frequency detector 45 associated with a RAM memory 46, and an processing circuit 47 intended in particular to supply control signals SC and detection signals SD. Frequency detector 45 and supply circuit 47 may each include either a logic circuit or a microprocessor.

Circuit 44, whose input 44*a* is connected to current source 43 and to multiplexer 42, forms an oscillator with each of capacitive elements S1 to S13. Its construction may be of the type described in European Patent No. 674 247, to which the reader may refer for more details. This circuit operates as a voltage-frequency converter, in other words a voltage controlled oscillator. The oscillation frequency of its output signal SF is inversely proportional to the capacitance of that of elements S1 to S13, which is connected thereto by multiplexer 42.

In operation, frequency detector 45 receives signal SF, measures its oscillation frequency by counting the periods in a predetermined time window, and compares this measurement to a stored value which corresponds to the intrinsic capacitance $C_0$ of the sensor concerned (i.e. connected by multiplexer 42) to determine whether the sensor is activated or not. Said intrinsic capacitance has been stored in memory 46 in an initialisation sequence of the detection device. Frequency detector 45 also controls multiplexer 42 and current source 43. The reference formed by capacitance S13 must allow, on the one hand, the charging/discharging current i of the capacitive sensors to be correctly adjusted, and on the other hand, the oscillator frequency drift to be measured, the frequency detector software then being able to compensate for such drift. The value of the reference capacitance must in any case be greater than the values of intrinsic capacitance $C_0$ of sensors S1 to S12. The state of the twelve sensors S1 to S12 and of reference capacitance S13 is determined sequentially by sweeping using multiplexer 42, preferably beginning with the reference capacitance.

The presence of minute hand 8 facing one of transparent electrodes 21 to 32 generates a capacitance increase in the corresponding sensor. However, since the surface of the hand is relatively small, this variation in capacitance is much smaller, for example five to ten times smaller than that generated by placing finger 38 on the crystal facing the same electrode. Detection circuit 45 is arranged to compare these variations to predetermined thresholds, to distinguish variations in capacitance caused by the hand from those caused by the finger. Consequently, the output signals which it supplies to processing circuit 47 indicate, on the one hand, which of sensors S1 to S12 is activated and, on the other hand, whether this activation is due to finger 48 or hand 8. Consequently, processing circuit 47 can supply a control signal SC if activation is due to the finger, or a detection signal SD if activation is due to the hand.

Preferably, processing circuit 47 is arranged to signal the passage of hand 8 from one of electrodes 21 to 32 to the following one, or from one of the electrodes to space 37 separating it from the following electrode. Since the hand is generally driven step-by-step, this allows the passage of the hand to predetermined positions to be detected precisely, every five minutes in the present example. Detection circuit 45 can store in memory 46 the values measured during a sweep and then compare the new measured values to the latter during the next sweep. Since the duration of a complete sweep can be quite short, for example between 30 and 200 ms depending on the number of sensors, this circuit may detect precisely the instant when hand 8 begins to cover one of the electrodes, even if it is still partially covering the preceding electrode. It is thus possible to reduce spaces 37 between electrodes and to use relatively wide hands, generating quite high capacitance variations which are thus easy to detect.

Those skilled in the art will understand that detection of the hand position allowed by the device described hereinbefore may advantageously be used to check the consistency of this position with the content of an electronic minute counter in the watch movement. When the position of the hand does not conform to the counter value, an automatic correction will be made by a suitable number of steps of the motor which drives the hand.

Generally, hour hand 9 is further from transparent electrodes 21 to 32 than minute hand 8. In this example, it has too small a surface area in proximity to electrodes 21 to 32 to disturb detection of the position of the minute hand. However, in other embodiments, hour hand 9 may be given sufficient size and placed close enough to crystal 5 to generate, in sensors S1 to S12, sufficient variation in capacitance to be able to be detected. Detection circuit 45 will then have to use an additional predetermined threshold to distinguish variations in capacitance due respectively to the hour hand and the minute hand.

Another solution, shown schematically in dotted lines in FIG. 1, consists in detecting the position of hour hand 9 by means of one or more fixed electrodes 51 placed on dial 11, thus closer to the hour hand than to minute hand 8. Each of fixed electrodes 51 thus constitutes, with hand 9, an additional capacitive sensor able to be connected to multiplexer 42 and swept by detection device 40 after sensors S1 to S12.

In other words, the same detection device 40 is capable of indicating the activation of a capacitive key by finger 38, the position of minute hand 8 and the position of hour hand 9. Of course, this hour hand detection system may be combined with other embodiments described hereinafter, and may also detect the position of another hand of the watch.

In order to limit electric power consumption, detection device 40 is normally inactive. It is preferably activated in two particular circumstances. The first is that in which the person wearing the watch wishes to activate one of the capacitive control keys by touching crystal 5. It must first switch the watch into a control mode, for example by pressing on push-button 15 or via action on the watch control stem. This action supplies an initialisation signal S1 to processing circuit 47, which will activate detection circuit 40 and generate the initialisation sequence by detection circuit 45. From this moment on, any activation of a capacitive key by finger 38 will be detected. The position of the hands may also be detected if necessary. The other circumstance is a periodic check of the position of the watch hand or hands. This check may be initialised either by check S1 described hereinbefore, or by a specific signal supplied to processing circuit 47, for example once or twice a day.

FIG. 4 shows another embodiment of a transparent electrode 61 which can be used in place of each of electrodes 21 to 32 described hereinbefore, i.e. twelve of these electrodes 61 may be provided on the periphery of crystal 5, which are separated by spaces 62 of substantially equal or greater width than that of minute hand 8. However, electrodes 61 do not cover the zone swept by hour hand 9. Electrode 61 is comb-shaped, with a base 63 which is continuous in a circumferential direction and five teeth 64 extending radially in the direction of the centre and separated by spaces 65 of the same width as spaces 62. The electric connection between each electrode 61 and the electronic watch circuits is achieved in the same way as in the preceding example. As a result of this arrangement of transparent electrodes, it is possible to detect precisely one hundred and twenty positions of minute hand 8, corresponding to the sixty teeth 64 and sixty spaces 62 and 65. These positions are counted from a reference position, defined for example by the first tooth 64 of the first of electrodes 61.

FIG. 5 shows another embodiment, including two different types of transparent electrodes 70 and 71 on the inner face of crystal 5 of watch 1 described hereinbefore. Each electrode 71 includes, outside the field swept by minute hand 8, an enlarged part 71*a* forming a capacitive key intended to co-operate with finger 38 of the user and identified for example by a symbol 72 which corresponds to the function controlled by the capacitive key. Each electrode 71 further includes a narrow part 71*b* which extends radially between the adjacent electrodes 70 and likewise is strip-shaped. Each of electrodes 70 and 71 is individually connected to the detection circuit. Together they form a circular row including, for example, thirty electrodes and thirty spaces 73 allowing sixty positions of hand 8 to be detected.

Figure 6:
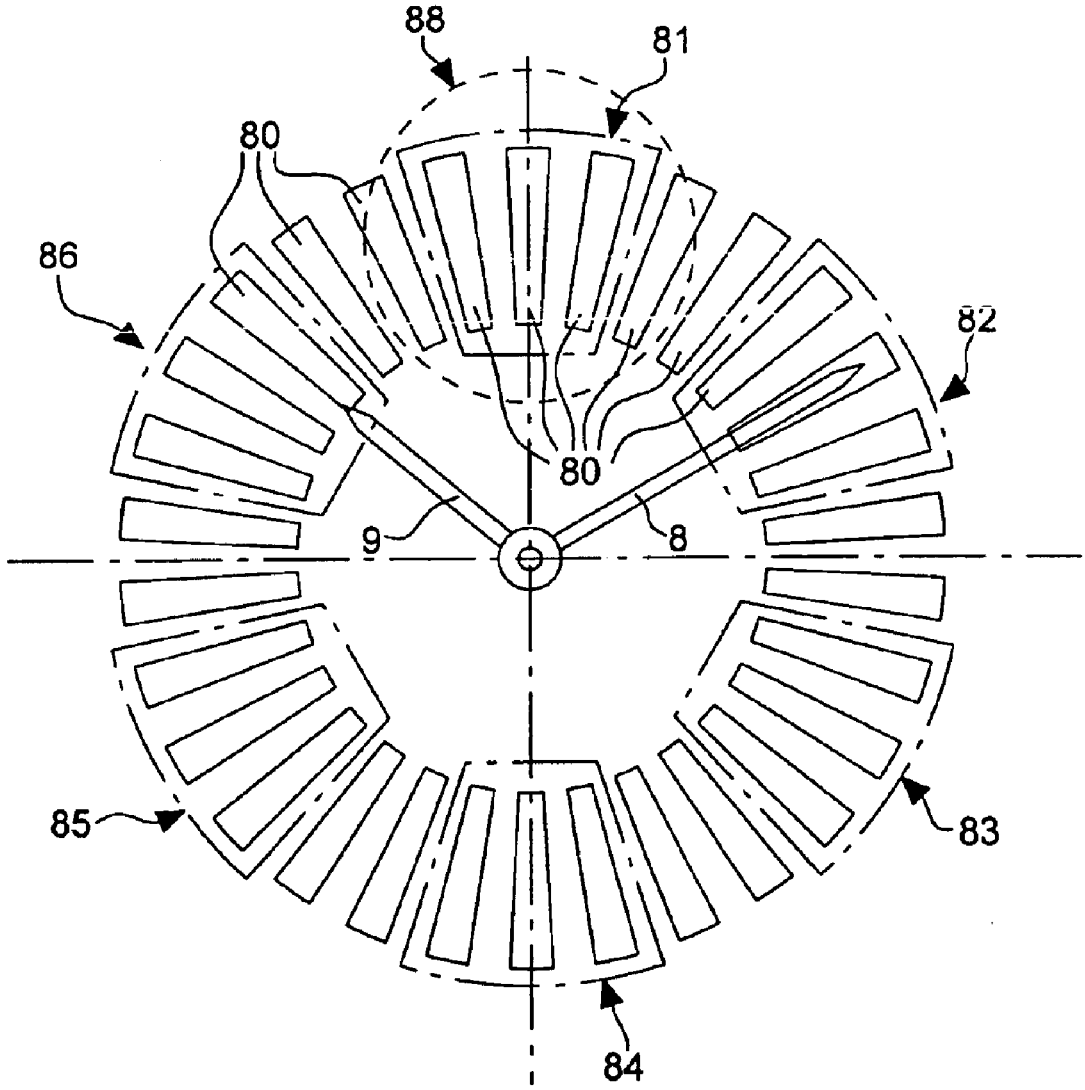
FIG. 6 shows a further embodiment of the transparent electrodes.

In another embodiment shown in FIG. 6, the arrangement of the transparent electrodes illustrated in FIG. 5 is modified to include only one circular row of thirty electrodes 80 in the form of radial strips, without the enlarged parts 71*a* shown in FIG. 5. Each capacitive key is thus defined by a group 81 to 86 of several (for example two or three) consecutive electrodes 80 able to be covered together by the user's finger. Detection device 40 is then arranged to distinguish between the cases in which a single electrode 80 is activated, which corresponds to the presence of hand 8 facing this electrode, and cases in which at least two (or all) of the adjacent electrodes 80 of a same group 81 to 86 are activated, which corresponds to the presence of the user's finger opposite such group. Reference 88 indicates for example a zone covered by the finger and in which the presence of the finger creates a variation in capacitance detected in all the electrodes of group 81 and in a few neighboring electrodes, but not in those of neighboring groups 82 and 86. Detection device 40 will detect that a few or all of the electrodes of group 81 are activated at the same moment. Consequently, it will indicate activation of the corresponding capacitive key by finger 38 (and not by hand 8) and will supply the control signal SC corresponding to that key.

One should also note the possibility of completing the electrode arrangements according to FIGS. 3 and 6 by other transparent electrodes acting as capacitive keys without playing any part in detecting the position of a hand, for example an electrode located at the centre of crystal 5.

In all the examples described hereinbefore, the operating method of detection device 40 includes two independent or simultaneous modes, which are controlled as a result of the software and/or the logic arrangement of elements 45 and 47 of this device: a control mode via capacitive keys, which the person wearing the watch deliberately switches on by means of a member such as push-button 15, and a hand detection mode which can be switched on and off automatically by the clockwork movement. The control mode can be switched off either by timing means or by a manual control. While the control mode is switched off, hand detection can be limited to a restricted region of the area travelled by the hand, for example to only one of the transparent electrodes or to a region including the last electrode to have detected the hand and the neighboring electrodes. This limitation is controlled by means of multiplexer 42. It allows either a saving in electric power, or an increase in the oscillation frequency measuring precision due to an enlargement of the period counting window.

The preceding description demonstrates that it is possible to complete the control device with capacitive keys disclosed in European Patent No. 674 247 with remarkably simple means, in order to detect the position of one or more hands of the watch in order to exploit this information in the electronic watch movement.

What is claimed is:

1. An electronic watch including:

a case containing display means with hands and provided with a crystal made of dielectric material arranged in front of said hands, manual control means comprising capacitive keys each provided with at least a transparent electrode arranged on the inner face of the crystal and forming a first plate of capacitive sensor whose second plate is formed by placing a finger of the person wearing the watch on an external face of the crystal selectively opposite at least one of said capacitive keys, said control means further including a detection device for detecting capacitance variations in said sensor and consequently generating control signals in the watch, and means for capacitive detection of a position of at least one of said hands, on the basis of variations in capacitance between said hand and at least one fixed electrode, wherein said fixed electrode is one of said transparent electrodes of the capacitive keys, wherein said hand is electrically connected to a fixed potential and wherein said hand position detection is achieved by means of said detection device associated with the capacitive keys.

2. A watch according to claim 1, wherein said detection device is arranged to distinguish relatively strong variations in capacitance, caused by placing a finger opposite one of the transparent electrodes, from smaller variations in capacitance, caused by the passage of a hand of the watch in proximity to said transparent electrode.

3. A watch according to claim 1, wherein said transparent electrodes are separated from each other by spaces in the shape of radial strips.

4. A watch according to claim 3, wherein said spaces are located facing hour symbols of a dial.

5. A watch according to claim 1, wherein said transparent electrodes substantially comb-shaped with spaced-apart teeth directed radially towards the centre of the watch.

6. A watch according to claim 1, wherein a capacitive key includes a group of said transparent electrodes, said detection device being arranged to distinguish variation in capacitance caused by placing a finger opposite several adjacent electrodes of said group, from the variation in capacitance caused by the passage of said hand in proximity to any of the electrodes of said groups.

7. A watch according to claim 1, wherein said detection device includes a control mode, intended to detect a finger placed opposite one of said capacitive keys, and a hand detection mode, intended to detect the position of at least one of said hands, said detection device being capable of operating either simultaneously in both modes, or in a single mode at a time.

8. An electronic watch including:

a case containing display means with hands and provided with a crystal made of dielectric material arranged in front of said hands, manual control means comprising capacitive keys each provided with at least a transparent electrode arranged on the inner face of the crystal and forming a first plate of capacitive sensor whose second plate is formed by placing a finger of the person wearing the watch on an external face of the crystal selectively opposite at least one of said capacitive keys, said control means further including a detection device for detecting capacitance variations in said sensor and consequently generating control signals in the watch, and means for capacitive detection of a position of at least one of said hands, on the basis of variations in capacitance between said hand and at least one fixed electrode, wherein said hand position detection is achieved by means of said detection device associated with the capacitive keys, wherein said fixed electrode is separated from said transparent electrodes of the capacitive keys.

9. A watch according to claim 8, wherein said transparent electrodes are separated from each other by spaces in the shape of radial strips.

10. A watch according to claim 9, wherein said spaces are located facing hour symbols of a dial.

11. A watch according to claim 8, wherein said transparent electrodes are substantially comb-shaped with spaced-apart teeth directed radially towards the centre of the watch.

12. A watch according to claim 8, wherein said fixed electrodes are formed of radial strips arranged in a circular row on the inner face of the crystal and wherein each transparent electrode of the capacitive keys includes a narrow part in the shape of a radial strip, extending into said row of fixed electrodes, and an enlarged part arranged outside said row.

13. A watch according to claim 8, wherein said fixed electrode is placed on the watch dial.

14. A watch according to claim 8, wherein said detection device includes a control mode, intended to detect a finger placed opposite one of said capacitive keys, and a hand detection mode, intended to detect the position of at least one of said hands, said detection device being capable of operating either simultaneously in both modes, or in a single mode at a time.

* * * * *